US008227971B2

(12) United States Patent
Kohno et al.

(10) Patent No.: US 8,227,971 B2
(45) Date of Patent: Jul. 24, 2012

(54) ULTRA-HIGH-PRESSURE MERCURY LAMP

(75) Inventors: Hidehiro Kohno, Yokohama (JP); Hideyuki Matsumoto, Yokohama (JP)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 13/183,526

(22) Filed: Jul. 15, 2011

(65) Prior Publication Data

US 2012/0013250 A1 Jan. 19, 2012

(30) Foreign Application Priority Data

Jul. 16, 2010 (JP) ..... 2010-161262

(51) Int. Cl.
*H01J 5/58* (2006.01)

(52) U.S. Cl. ..... 313/318.11; 313/113; 313/318.08

(58) Field of Classification Search ..... 313/623–624, 313/113, 318.01–318.12
See application file for complete search history.

(56) References Cited

FOREIGN PATENT DOCUMENTS

| | | | | |
|---|---|---|---|---|
| JP | 10188920 | A | * | 7/1998 |
| JP | 2000003614 | A | * | 1/2000 |
| JP | 2005164897 | A | * | 6/2005 |
| JP | 2006236645 | A | * | 9/2006 |
| JP | 2009140628 | A | * | 6/2009 |

* cited by examiner

*Primary Examiner* — Mariceli Santiago

(57) ABSTRACT

An ultra-high-pressure mercury lamp according to various embodiments is an ultra-high-pressure mercury lamp in which a luminous tube employing a quartz bulb is attached to a neck part of a reflector by injecting first cement, and a metal base is attached to the neck-part end of the luminous tube by injecting second cement, wherein, if a is the outer diameter of the first cement and second cement after injection, b is the total axial depth of the first cement and second cement after injection, and c is the outer diameter of the quartz bulb in the vicinity of the luminous tube where the metal base is attached, the following relationships are satisfied: $1.3<a/c<2.4$; $0.5<b/c<1.6$.

1 Claim, 10 Drawing Sheets

ULTRA-HIGH-PRESSURE MERCURY LAMP

CROSS-REFERENCE TO RELATED APPLICATION

This application claims priority to Japanese patent application Serial No. 2010-161262, which was filed Jul. 16, 2010, and is incorporated herein by reference in its entirety.

TECHNICAL FIELD

Various embodiments relate to an ultra-high-pressure mercury lamp which is used as a light source in a projector device.

BACKGROUND

FIG. 8 schematically shows a conventional ultra-high-pressure mercury lamp 200. This conventional ultra-high-pressure mercury lamp 200 is provided with a reflector 203 which has a surface that acts as a concave reflector formed on the inner surface thereof. A cylindrical protrusion, namely a neck part 203*b*, is formed on the outer surface of the reflector 203 at a position adjoining the bottom part of the concave reflector of the reflector 203. A luminous tube 202 of the ultra-high-pressure mercury lamp 200 has a cylindrical outer shape, and one end thereof runs from the bottom part of the reflector 203 through the neck part 203*b*, the luminous tube 202 being fixed together with a metal base 215 by means of cement 218 which is encapsulated between said luminous tube 202 and the inner wall of the neck part 203*b*. Front glass 219 is fitted into an opening 203*a* in the reflector 203 (see JP 2004-349194 A, for example).

As described above, the luminous tube 202 of the ultra-high-pressure mercury lamp 200 has a cylindrical outer shape, and one end thereof runs from the bottom part of the reflector 203 through the neck part 203*b*, the luminous tube 202 being fixed together with a metal base 215 by means of cement 218 which is encapsulated between said luminous tube 202 and the inner wall of the neck part 203*b*. In this case, the attachment of the luminous tube 202 and metal base 215 by means of the cement 218 is carried out in two stages. Firstly, when the luminous tube 202 is inserted into the reflector 203 after sealing with molybdenum foil at a quartz bulb, attachment by means of first cement 218 is performed (during alignment). In addition, when the metal base 215 is fixed, attachment by means of second cement 218 is performed (during fitting of the metal base).

Although the first and second cements 218 mentioned above are the same type of cement, when the second cement 218 is injected and dried in an oven in the metal base fitting process, the linear expansion coefficient is different because of variations in the uniformity etc. (particle size, distribution etc.), and the quartz bulb close to the boundary of the first and second cements 218 is subjected to shear stress, which leads to issues in that cracks are produced in the quartz bulb.

Moreover, it is believed that the quartz bulb close to the boundary of the first and second cements 218 is also subjected to thermal stress (shear stress) outside of the process for producing the ultra-high-pressure mercury lamp 200, when said lamp is illuminated/extinguished, for example.

SUMMARY

Various embodiments have been devised in order to resolve the above issue, by providing an ultra-high-pressure mercury lamp in which it is possible to suppress the formation of cracks in a quartz bulb caused by injecting cement in two stages, namely during alignment for attaching a luminous tube to a reflector, and during metal base fitting for attaching a metal base.

The ultra-high-pressure mercury lamp according to various embodiments is an ultra-high-pressure mercury lamp in which a luminous tube employing a quartz bulb is attached to a neck part of a reflector by injecting first cement, and a metal base is attached to the neck-part end of the luminous tube by injecting second cement, wherein, if a is the outer diameter of the first cement and second cement after injection, b is the total axial depth of the first cement and second cement after injection, and c is the outer diameter of the quartz bulb in the vicinity of the luminous tube where the metal base is attached, the following relationships are satisfied:

$$1.3<a/c<2.4 \quad (1)$$

$$0.5<b/c<1.6 \quad (2).$$

With the ultra-high-pressure mercury lamp according to various embodiments, if a is the outer diameter of the first cement and second cement after injection, b is the total axial depth of the first cement and second cement after injection, and c is the outer diameter of the quartz bulb in the vicinity of the luminous tube where the metal base is attached, the following relationships are satisfied:

$$1.3<a/c<2.4 \quad (1)$$

$$0.5<b/c<1.6 \quad (2)$$

and as a result it is possible to suppress the formation of cracks in the quartz bulb close to the boundary of the first cement and second cement.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Mode of Embodiment 1

It is currently the case that ultra-high-pressure mercury lamps are sealed with Mo (molybdenum) foil at the quartz bulb, and the luminous tube and metal base are attached inside the reflector using cement during alignment. The attachment using cement is divided into two stages, namely attachment of the luminous tube to the reflector, and attachment of the metal base. A phenomenon of crack formation in the quartz bulb close to the interface of the first cement and second cement is encountered in this process.

Figure 1:
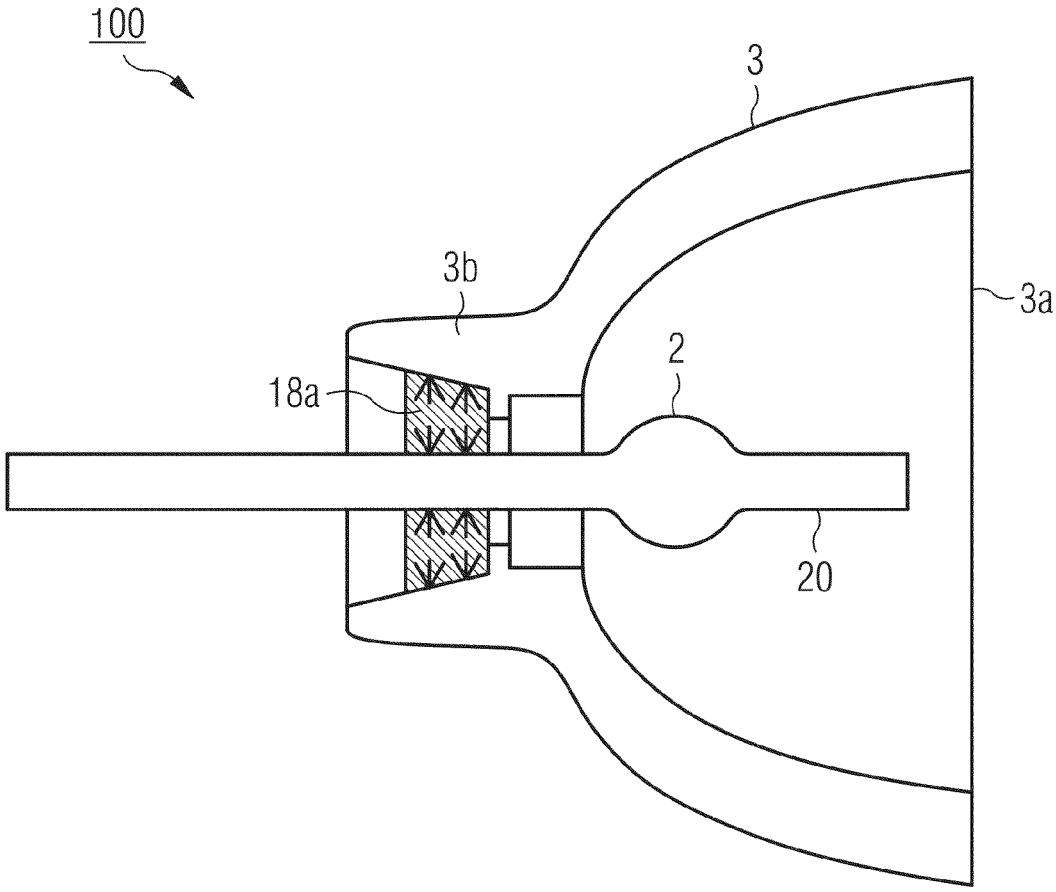
FIG. 1 shows Mode of Embodiment 1 and schematically shows a situation when a luminous tube 2 has been attached to a reflector 3 using cement 18*a* in an ultra-high-pressure mercury lamp 100.

The phenomenon of crack formation will be described first of all. FIG. 1 depicts Mode of Embodiment 1 and schematically shows a situation when a luminous tube 2 has been attached to a reflector 3 using cement 18*a* in an ultra-high-pressure mercury lamp 100. The luminous tube 2 of the ultra-high-pressure mercury lamp 100 is housed inside the reflector 3 (which is a parabolic reflector in the example in FIG. 1). The luminous tube 2 is attached to a neck part 3*b* of the reflector 2 by means of cement 18*a*. The central axis of the luminous tube 2 matches the central axis linking an opening 3*a* in the reflector 3 and the neck part 3*b*, and the luminous tube 2 is attached in a state in which the center of the light-emitting section thereof is the focal point of the reflector 3.

The luminous tube 2 has a typical structure so it will not be described in detail. The luminous tube 2 comprises a pair of electrode systems (not depicted). The electrode systems comprise electrodes, foil, and lead wires, etc. Mercury and noble gas (e.g. argon) which are not depicted are encapsulated inside the luminous tube 2. The two ends of the luminous tube 2 are then sealed by heating/fusing a quartz bulb 20.

Figure 2:
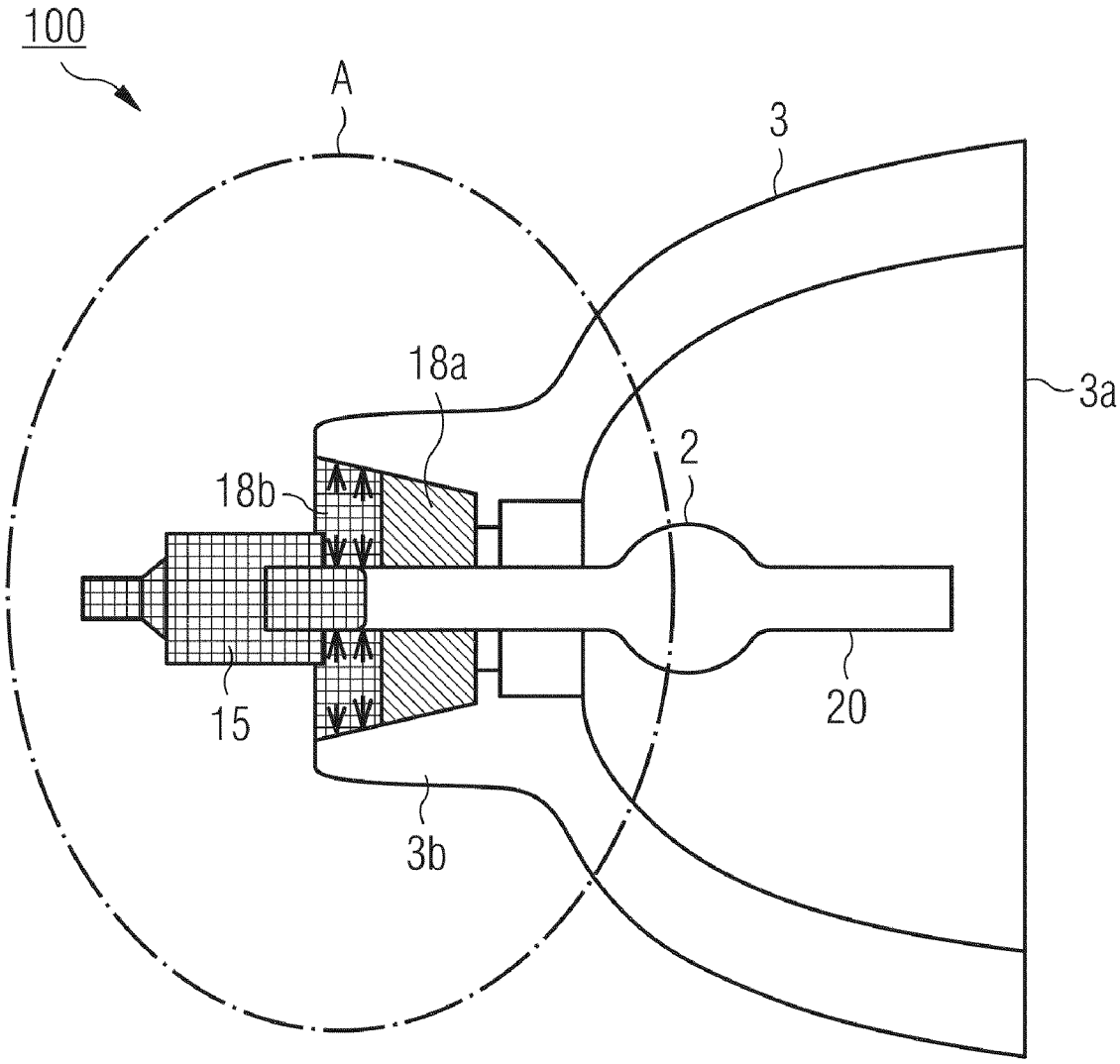
FIG. 2 shows Mode of Embodiment 1 and schematically shows a situation when a metal base 15 has been attached to the luminous tube 2 using cement 18*b* in the ultra-high-pressure mercury lamp 100.

FIG. 2 depicts Mode of Embodiment 1 and schematically shows a situation when a metal base 15 has been attached to the luminous tube 2 using cement 18*b* in the ultra-high-pressure mercury lamp 100. The two ends of the luminous tube 2 are sealed by heating/fusing the quartz bulb 20, after which the metal base 15 is attached to the neck part 3*b* end of the reflector 3 using the cement 18*b*. The cement 18*b* is the same as the cement 18*a* for attaching the luminous tube 2 to the neck part 3*b* of the reflector 3.

Figure 3:
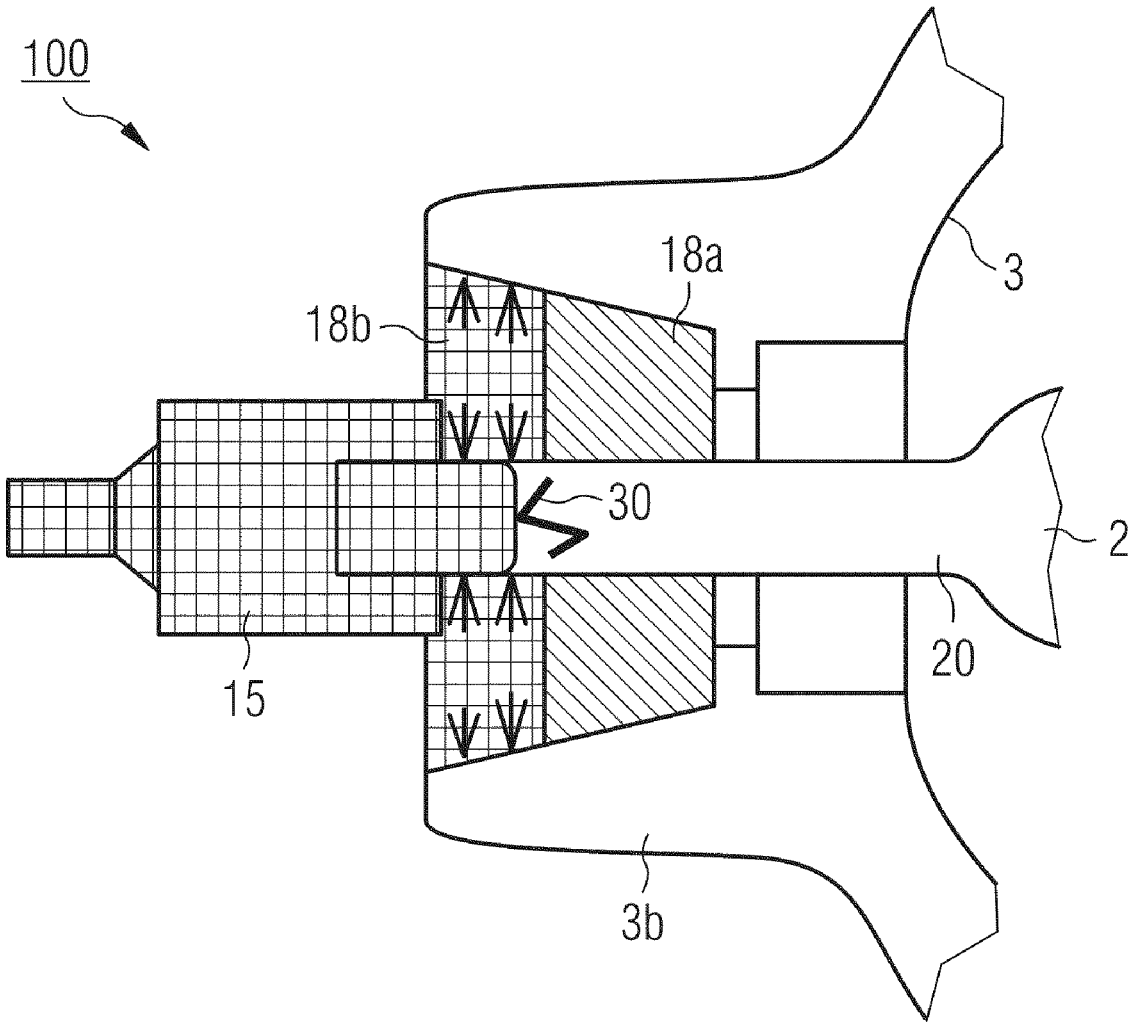
FIG. 3 shows an enlargement of part A in FIG. 2.

FIG. 3 is an enlargement of part A in FIG. 2. Although the cement 18*a* and the cement 18*b* are the same type of cement, it is believed that when the second cement 18*b* is injected and dried in an oven in the metal base 15 attachment step, the linear expansion coefficient is different because of variations in the uniformity etc., and the quartz bulb 20 close to the boundary (interface) of the cement 18*a* and cement 18*b* is subjected to shear stress.

A comparison of the linear expansion coefficients of the cements 18*a*, 18*b* and the quartz bulb 20 shows that the linear expansion coefficient of the cements 18*a*, 18*b* is approximately 20 times greater. This means that when the cements 18*a*, 18*b* are dried, or when the lamp is illuminated/extinguished, stress is applied to the quartz bulb 20 because of the change in volume of the cements 18*a*, 18*b* (the volume inside of the neck part 3*b* of the reflector 3 undergoes little temperature-induced change compared with the cements 18*a*, 18*b* because of the difference in linear expansion coefficient, so the cements 18*a*, 18*b* expand axially or inwardly, for example, during drying).

Therefore, although the cement 18*a* and the cement 18*b* are the same type of cement, it is believed that when the second cement 18*b* is injected and dried in an oven in the metal base 15 attachment step, the linear expansion coefficient is different because of variations in the uniformity etc., and the quartz bulb 20 close to the boundary (interface) of the cement 18*a* and cement 18*b* is subjected to shear stress.

As shown in FIG. 3, the quartz bulb 20 close to the boundary (interface) of the cement 18*a* and cement 18*b* is subjected to shear stress, and a crack 30 is formed.

Figure 4:
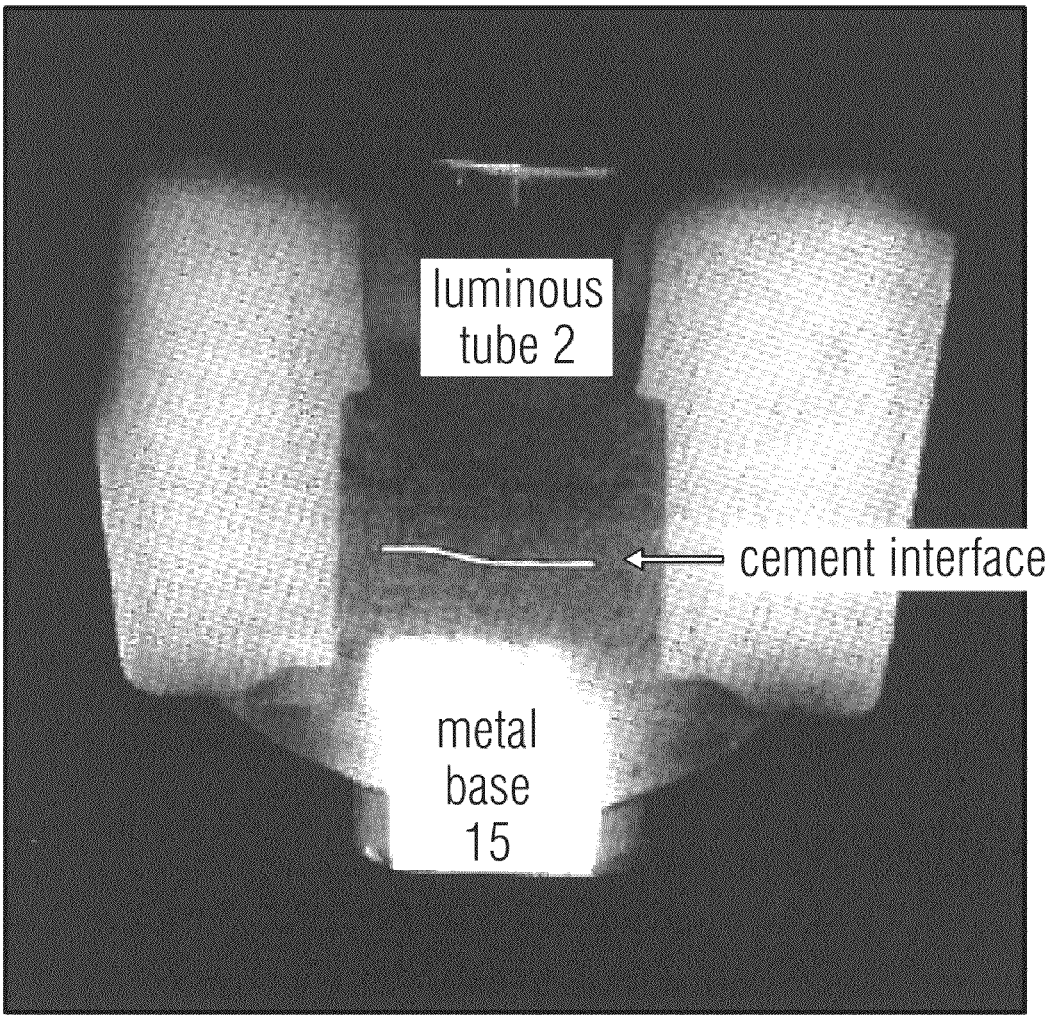
FIG. 4 shows Mode of Embodiment 1 and shows the interface of the cement 18*a* and the cement 18*b;*
Figure 5:
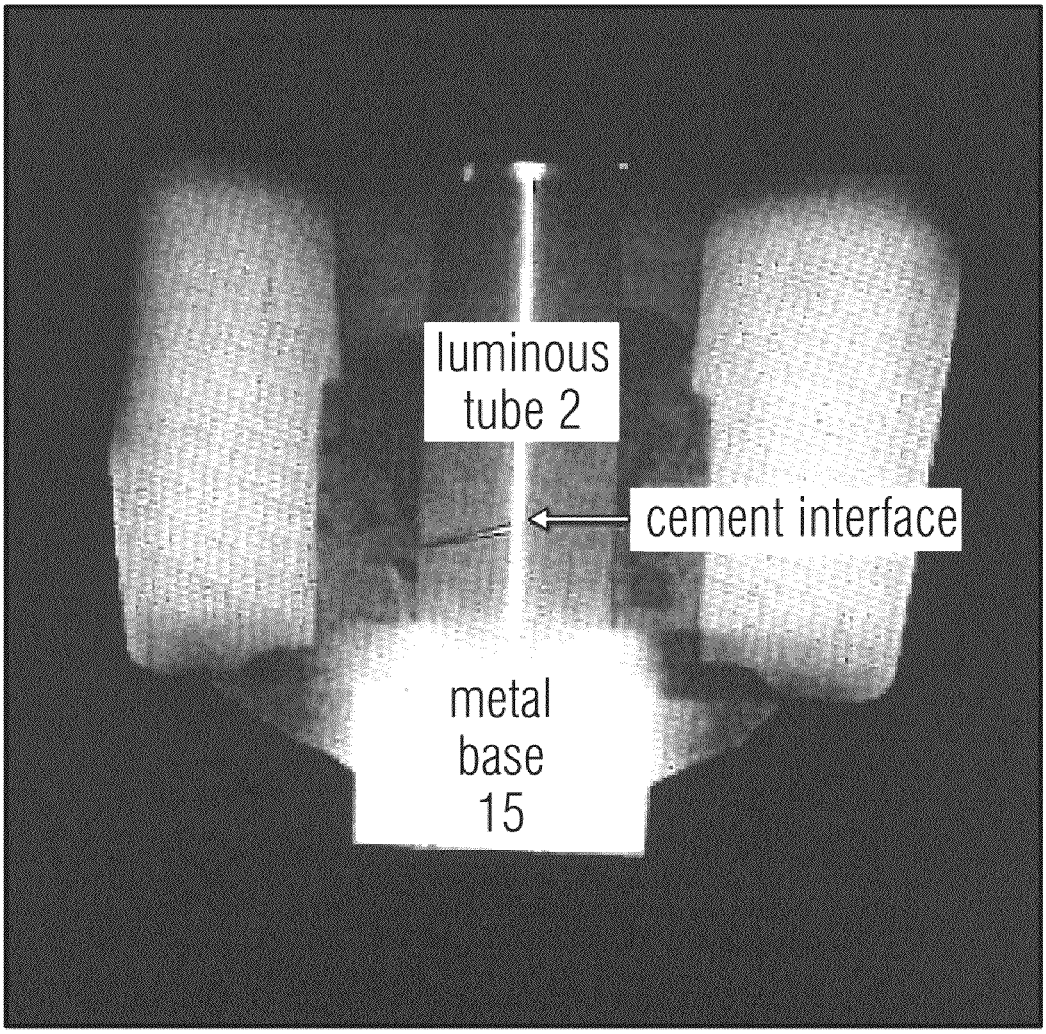
FIG. 5 shows Mode of Embodiment 1 and shows a crack in a quartz bulb close to the interface of the cement 18*a* and the cement 18*b;*

FIG. 4 and FIG. 5 depict Mode of Embodiment 1, where FIG. 4 shows the interface of the cement 18*a* and the cement 18*b*, and FIG. 5 shows a crack in the quartz bulb 20 close to the interface of the cement 18*a* and the cement 18*b*. When the product (the ultra-high-pressure mercury lamp 100) was actually viewed in a disassembled state, a crack was formed at the surface of the quartz bulb 20 close to the cement interface shown in FIG. 4 (see FIG. 5).

Figure 6:
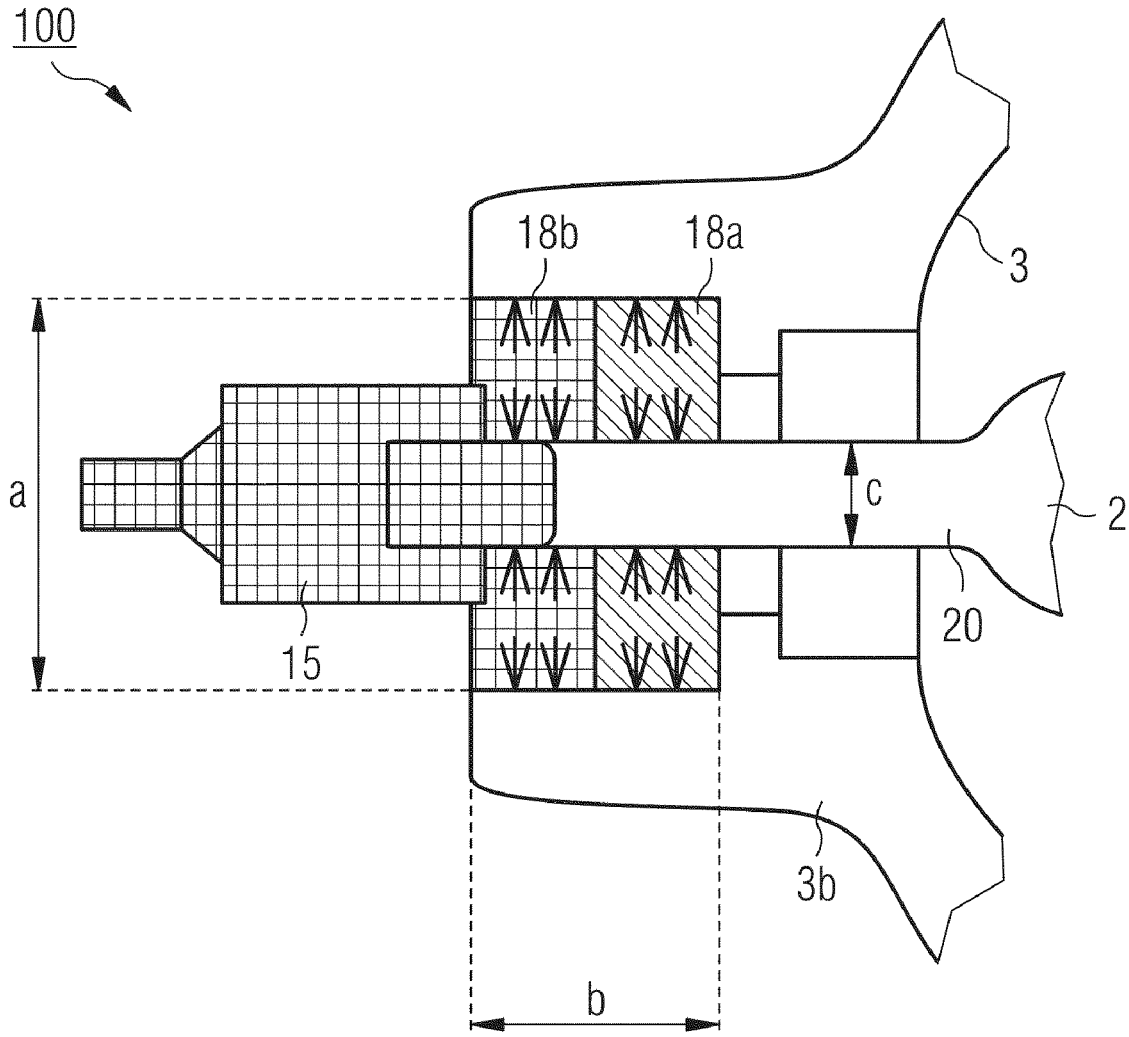
FIG. 6 shows Mode of Embodiment 1 and schematically shows the vicinity of a neck part 3*b* of the reflector 3 of the ultra-high-pressure mercury lamp 100.
Figure 7:
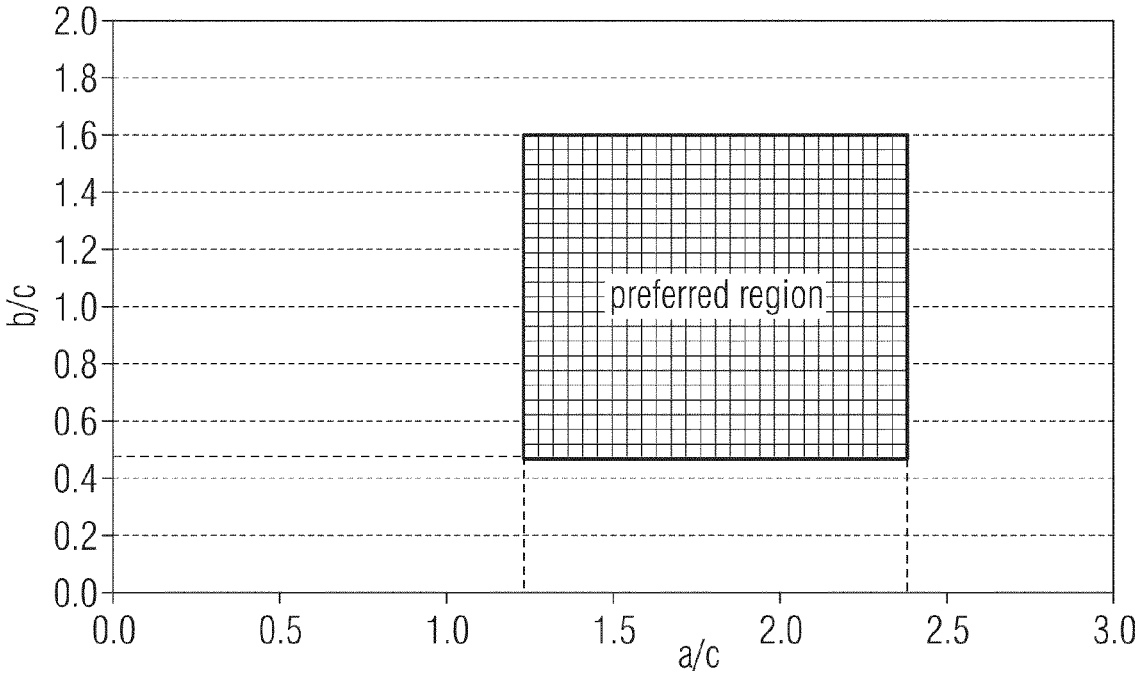
FIG. 7 shows Mode of Embodiment 1 and shows the cement volume region which is effective for suppressing the formation of cracks in the quartz bulb.
Figure 8:
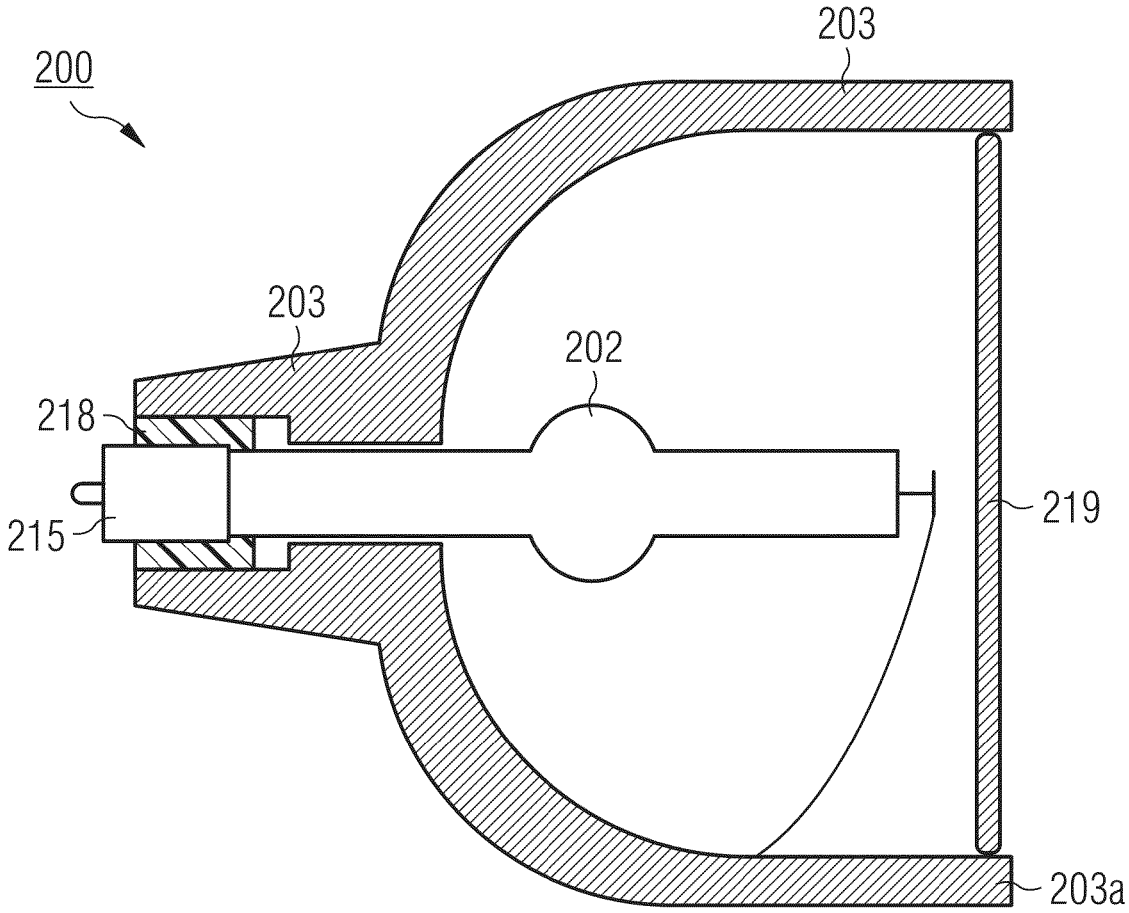
FIG. 8 schematically shows a conventional ultra-high-pressure mercury lamp 200.
Figure 9:
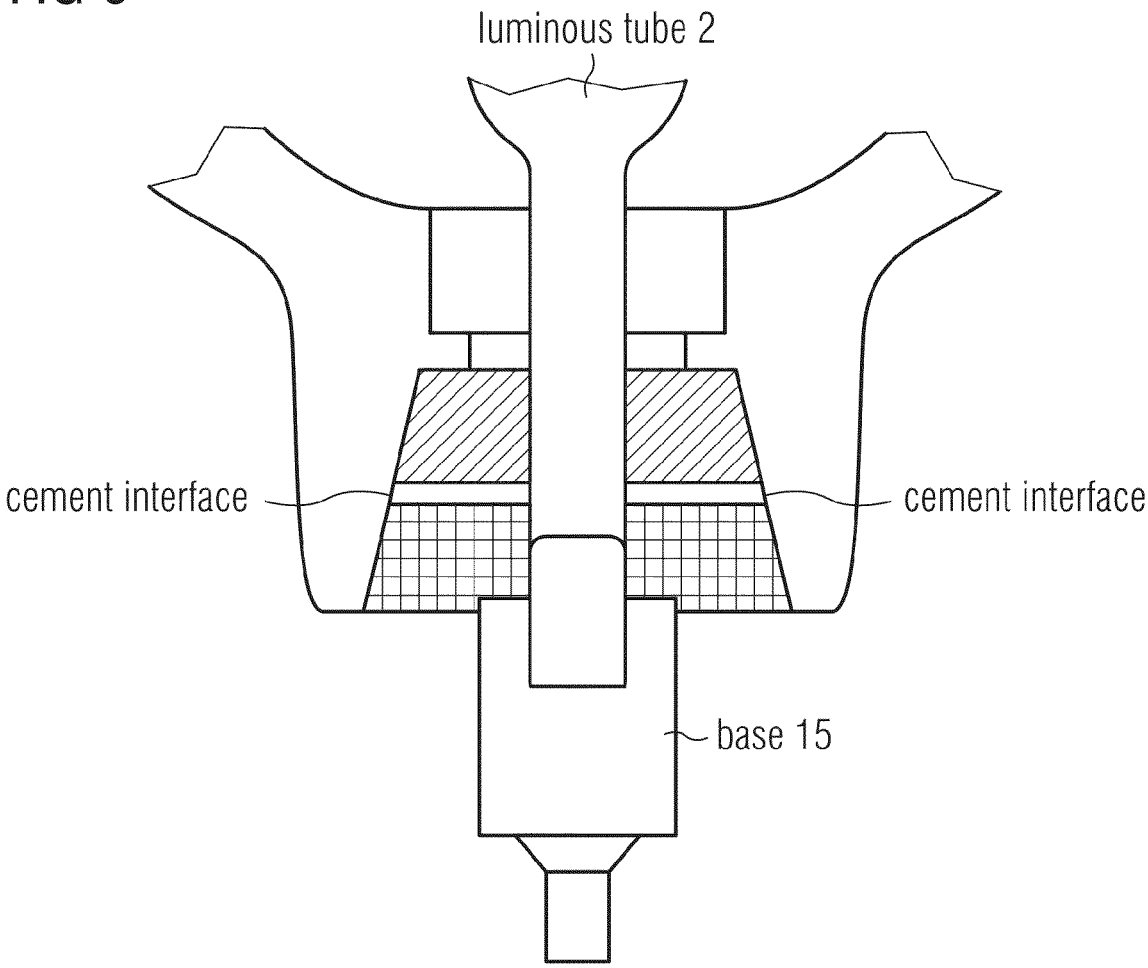
FIG. 9 schematically shows a conventional ultra-high-pressure mercury lamp in accordance with various embodiments.
Figure 10:
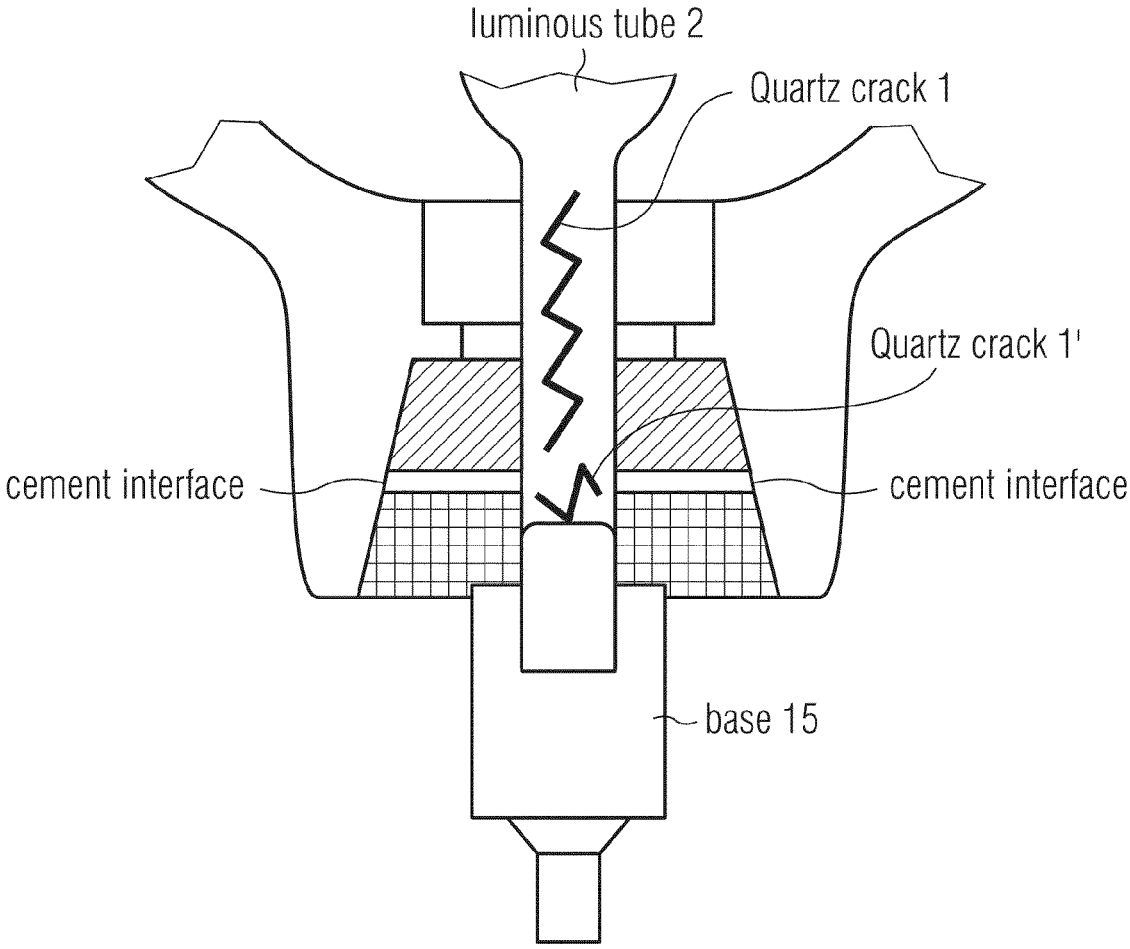
FIG. 10 schematically shows a conventional ultra-high-pressure mercury lamp in accordance with various embodiments.

FIG. 6 and FIG. 7 depict Mode of Embodiment 1, wherein FIG. 6 schematically shows the vicinity of the neck part 3*b* of the reflector 3 of the ultra-high-pressure mercury lamp 100, and FIG. 7 shows the cement volume region which is effective for suppressing the formation of cracks in the quartz bulb.

The formation of cracks at the surface of the quartz bulb 20 close to the cement interface described above in the ultra-high-pressure mercury lamp 100 according to this mode of embodiment is suppressed by reducing the volume of cement injected into the reflector 3.

As already described, when the cements 18*a*, 18*b* are dried, or when the lamp is illuminated/extinguished, stress is applied to the quartz bulb 20 because of the change in volume of the cements 18*a*, 18*b* due to the difference in linear expansion coefficient of the cements 18*a*, 18*b* and the quartz bulb 20.

The rate of expansion of the cement (the cements 18*a*, 18*b*) is proportional to the volume of cement, and therefore, assuming that the reflector 3 does not deform, it is believed that the thermal stress is also proportional to the volume of cement.

The invention is not limited to the luminous tube 2 always being at the axial center of the reflector 3, the volume distribution of the cement (the cements 18*a*, 19*a*) around the quartz bulb 20 may be uneven, and there may also be deviations in the thermal stress to which the quartz bulb 20 is subjected.

It is believed that some of the shear stress to which the quartz bulb 20 is subjected as a result of variations in the thermal stress to which the quartz bulb 20 is subjected exceeds the strength thereof, and cracks are formed.

The relationship between the volume expansion rate B of a solid and the linear expansion coefficient $\alpha$ of an object is such that $B=3\alpha$, and therefore it is believed that reducing the volume of cement injected into the reflector 3 (the cements 18*a*, 18*b*) has an effect of reducing the thermal stress to which the quartz bulb 20 is subjected.

In FIG. 6, the dimensions of the cement (the cements 18*a*, 18*b*) and the luminous tube are defined in the following manner.

(1) The diameter of the outer periphery of the cement (the cements 18*a*, 18*b*) after injection is a [mm] (the cement is cylindrical in shape);

(2) The depth (axial length) of the cement (the cements 18*a*, 18*b*) is b [mm]; and (3) The outer diameter of the luminous tube 2 is c.

As one example, it was possible to confirm that there were fewer cracks formed in the quartz bulb 20 by changing the diameter a of the cement from 13 mm to 12 mm, and by changing the depth b of the cement from 9.5 mm to 8.0 mm. Here, the outer diameter c of the basic tube of the quartz bulb 20 was 6 mm (the sealing part was smaller than this).

Assuming that the outer diameter c of the quartz bulb 20 at the sealing part was 5 mm, the above results showed the following when the outer diameter c of the quartz bulb 20 at the sealing part was taken as a reference.

$$a/c=13/5=2.6 \rightarrow a/c=12/5=2.4$$

$$b/c=9.5/5=1.9 \rightarrow b/c=8.0/5=1.6$$

That is to say, there was an effect of suppressing the formation of cracks in the quartz bulb 20 when a/c<2.4 and b/c<1.6. However, if a/c is excessively small, the adhesive strength of the reflector 3 and the luminous tube 2 is inadequate. It is necessary to satisfy 1.3<a/c from the point of view of the adhesive strength of the reflector 3 and the luminous tube 2. Accordingly, in order to suppress the formation of cracks in the quartz bulb 20 a/c must satisfy the following expression (1).

$$1.3<a/c<2.4 \quad (1)$$

In addition, if b/c is excessively small, the adhesive strength of the reflector 3 and the luminous tube 2 is inadequate. It is necessary to satisfy 0.5<b/c from the point of view of the adhesive strength of the reflector 3 and the luminous tube 2. Accordingly, in order to suppress the formation of cracks in the quartz bulb 20 b/c must satisfy the following expression (2) (AND condition).

$$0.5<b/c<1.6 \quad (2)$$

The region which satisfies the abovementioned expressions (1) and (2) is the "preferred region" shown in FIG. 7.

As described above, if the diameter of the outer periphery of the cement (the cements 18*a*, 18*b*) after injection is a [mm], the depth (axial length) of the cement (the cements 18*a*, 18*b*) is b [mm], and the outer diameter of the luminous tube 2 is c, then it is possible to suppress the formation of cracks in the quartz bulb 20 by constructing the lamp in such a way as to satisfy the relationships 1.3<a/c<2.4 and 0.5<b/c<1.6.

Reference numbers: 2 luminous tube, 3 reflector, 3*a* opening, 3*b* neck part, 15 metal base, 18*a* cement, 18*b* cement, 20 quartz bulb, 30 crack, 100 ultra-high-pressure mercury lamp, 200 ultra-high-pressure mercury lamp, 202 luminous tube, 203 reflector, 203*a* opening, 203*b* neck part, 215 metal base, 218 cement, 219 front glass.

Various embodiments provide an ultra-high-pressure mercury lamp in which it is possible to suppress the formation of cracks in a quartz bulb caused by injecting cement in two stages, namely during alignment for attaching a luminous tube to a reflector, and during metal base fitting for attaching a metal base.

An ultra-high-pressure mercury lamp according to various embodiments is an ultra-high-pressure mercury lamp in which a luminous tube employing a quartz bulb is attached to a neck part of a reflector by injecting first cement, and a metal base is attached to the neck-part end of the luminous tube by injecting second cement, wherein, if a is the outer diameter of the first cement and second cement after injection, b is the total axial depth of the first cement and second cement after injection, and c is the outer diameter of the quartz bulb in the vicinity of the luminous tube where the metal base is attached, the following relationships are satisfied:

$$1.3<a/c<2.4 \quad (1)$$

$$0.5<b/c<1.6 \quad (2).$$

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. An ultra-high-pressure mercury lamp in which a luminous tube employing a quartz bulb is attached to a neck part of a reflector by injecting first cement, and a metal base is attached to the neck-part end of the luminous tube by injecting second cement, wherein if a is the outer diameter of the first cement and second cement after injection, b is the total axial depth of the first cement and second cement after injection, and c is the outer diameter of the quartz bulb in the vicinity of the luminous tube where the metal base is attached, the following relationships are satisfied:

$$1.3<a/c<2.4; \text{ and}$$

$$0.5<b/c<1.6.$$

* * * * *